United States Patent [19]

Göbl

[11] 4,288,002

[45] * Sep. 8, 1981

[54] THERMALLY INSULATED VESSEL, ESPECIALLY FOR LIQUEFIED GASES

[75] Inventor: Horst Göbl, Garching, Fed. Rep. of Germany

[73] Assignee: Linde AG, Wiesbaden, Fed. Rep. of Germany

[ * ] Notice: The portion of the term of this patent subsequent to Dec. 4, 1996, has been disclaimed.

[21] Appl. No.: 74,777

[22] Filed: Sep. 12, 1979

Related U.S. Application Data

[63] Continuation-in-part of Ser. No. 636,964, Dec. 2, 1975, Pat. No. 4,176,761.

[30] Foreign Application Priority Data

Dec. 4, 1974 [DE] Fed. Rep. of Germany ..... 2457264

[51] Int. Cl.[3] ..... F17C 3/08; B65D 81/18; B65D 88/06

[52] U.S. Cl. ..... 220/438; 220/425; 220/442; 220/901

[58] Field of Search ..... 220/425, 435–438, 220/440, 442, 901

[56] References Cited

U.S. PATENT DOCUMENTS

| | | | |
|---|---|---|---|
| 2,706,575 | 4/1955 | Soherr | 220/437 |
| 2,952,380 | 9/1960 | Hampton et al. | 220/425 |
| 3,154,212 | 10/1964 | Brush | 220/437 |
| 3,378,162 | 4/1968 | Smith | 220/442 |
| 4,176,761 | 12/1979 | Gubl | 220/438 |

FOREIGN PATENT DOCUMENTS

| | | | |
|---|---|---|---|
| 612919 | 7/1958 | Canada | 220/901 |

*Primary Examiner*—Stephen Marcus
*Attorney, Agent, or Firm*—Karl F. Ross

[57] ABSTRACT

A thermally insulated storage or transport vessel for low-boiling point liquefied gases comprises a rigid self-supporting inner receptacle or tank and a nonself-supporting outer container. The outer container is formed from a pair of longitudinally spaced opposing rigid end shells interconnected by an intermediate shell provided with stiffening formations extending peripherally of the intermediate shell. The intermediate shell is longitudinally expansible or contractile and may be formed with angular-section on curved-section corrugations.

6 Claims, 8 Drawing Figures

THERMALLY INSULATED VESSEL, ESPECIALLY FOR LIQUEFIED GASES

CROSS REFERENCE TO RELATED APPLICATION

This application is a continuation in part of Ser. No. 636,964 filed Dec. 2, 1975, now U.S. Pat. No. 4,176,761 issued Dec. 4, 1979.

FIELD OF THE INVENTION

My present invention relates to thermally insulated, so-called double-wall transport or storage vessels especially for low-boiling-point liquefied gases.

BACKGROUND OF THE INVENTION

It is known to provide thermally insulated vessels for low-boiling liquids and especially liquefied gases such as liquefied natural gas, methane, ammonia, nitrogen or oxygen, which consists of an inner receptacle containing the liquefied gas, frequently under pressure, and an outer vessel separated from the inner vessel by an insulation-filled and/or evacuated space.

Such vessels may be provided upon vehicles, ships or the like for the transportation of the liquefied gas or may be located at fixed sites for the storage of liquefied gas convenient to location at which a liquefied gas is produced or consumed.

The present invention relates primarily to storage or transport vessels in which the interwall space is evacuated, i.e. to so-called vacuum-insulated double-wall vessels.

In vessels of the latter type the outer and inner receptacles are generally both made so as to be highly rigid and can bear upon one another with bearing elements capable of yielding or otherwise adapted to take up the changes in length of the receptacles with temperature fluctuations. The vessel may be subjected to large temperature variations, i.e. a temperature change between ambient and the boiling point of the liquefied gas.

The outer receptacle has, because of its rigid and massive configuration, considerable weight. This is a disadvantage when the vessel is to be used for the transport of liquefied gases since it reduces the payload which can be carried by the ship or vehicle. Even where the vessel is to be fixedly located, the massive character of the outer receptacle is a disadvantage because of the high material and construction costs.

It has been proposed to reduce the weight of the outer vessel by making the latter of a smaller wall thickness and stiffening it at selected locations with a plurality of stiffening rings. The disadvantage of this arrangement is that it requires considerable work and high labor costs.

OBJECTS OF THE INVENTION

It is the principal object of the present invention to provide a thermally insulated storage or transport vessel having an inner and an outer receptacle wherein the outer receptacle has a minimal weight, can be fabricated at low cost and nevertheless has considerable stability against external pressure.

Another object of the invention is to provide a more economical and efficient transport and storage vessel for liquefied gases capable of withstanding large temperature variations.

SUMMARY OF THE INVENTION

These objects and other which will become apparent hereinafter are attained, in accordance with the present invention, in a thermally insulated vessel for the storage and transport of liquefied gases in which an inner receptacle is surrounded by an outer receptacle spaced from the inner receptacle, the space therebetween preferably being evacuated, the outer receptacle comprising a pair of opposite rigid shell members interconnected by an intermediate member sealingly secured to the shell members and stiffened circumferentially by formations formed directly and unitarily in this intermediate member.

This solution permits at least the intermediate members of part of the outer shell to be made of a reduced wall thickness since the stiffening formations prevent undesirable bulging of the outer receptacle in the circumferential direction. The construction can be made with labor costs no greater than those used with conventional rigid vessels and has a substantially reduced weight.

When the double-wall vessel is of generally cylindrical configuration, an optimum reduction of weight can be obtained without a static weakening of the outer receptacle when the rigid shell members constitute the cylinder bottoms or domes at the opposite axial end of the outer receptacle and the intermediate members provided with the stiffening formations consists of the cylindrical wall of the outer receptacle bridging the cylinder bottoms or domes.

The formations along the circumference of the cylinder wall can be made of simple angular or rounded (arcuate) circumferential corrugations, having troughs and peaks lying in planes perpendicular to the longitudinal axis of the receptacle.

This corrugated arrangement provides excellent elasticity in the direction of the longitudinal axis of the receptacle and permits a relatively large expansion and contraction of the outer receptacle for compensating changes in temperature, or a substantial expansion of the outer receptacle in the case of rupture of the inner receptacle.

It has been found to be advantageous to provide supporting elements between the outer and inner receptacles in the region of the cylinder bottom and to make these supporting elements also rigid or nonyielding. Changes of length of the inner receptacle can thereby be transferred to the outer receptacle without difficulty.

It has also been found to be advantageous to support the transport or storage vessel upon a frame which can extend continuously below the entire vessel or can be divided into two or more relatively movable frame members. Where the continuous frame is provided, the support of the vessel upon the frame is preferably effected at the support element between the inner and outer receptacles. However, at one end of the vessel, the support elements are connected yieldably (in the longitudinal direction) to the frame (yieldably mounted).

The force applied to the vessel and by the vessel to the support frame all act on the vessel at the rigid domed cylinder bottoms which are capable of withstanding such forces with ease. The domed cylinder bottoms thus are capable of taking up supporting forces, reaction forces resulting from movements of the liquid during transport, acceleration and deceleration forces in the longitudinal, transverse and vertical directions, and thermal forces or pressure forces within the inner receptacle; thus the latter can constitute a pressurized container.

Because of the longitudinal flexibility of the outer receptacle it is not necessary to make additional arrangements to compensate for shrinkage of the receptacles upon cooling. The inwardly directed external pressure can be applied to the rigid inner receptacle from the outer receptacle and is thereby taken up with ease.

It has been found to be advantageous, especially for long vessels, to support the latter upon a divided frame, i.e. on a frame having two or more frame sections. Each of the frame sections can carry, by a fixed mount, a respective cylinder bottom and support element, while the inner receptacle is supported on the frame section with yieldable mounts for freedom of movement in the longitudinal direction. The yieldable mounts described above are intended to permit longitudinal movement, i.e. movement parallel to the axis of the vessel, but prevent movement in the vertical and transverse direction.

BRIEF DESCRIPTION OF THE DRAWING

The above and other objects, features and advantages of the present invention will become more readily apparent from the following description, reference being made to the accompanying drawing in which.

SPECIFIC DESCRIPTION

The vessel 1, for liquefied gas, is mounted upon a continuous frame 10 and comprises a cylindrical pressurized and pressure-sustaining inner container with a cylindrical intermediate part 4 and two domed cylinder bottoms 5 welded at 5' to the intermediate part 4.

Figure 7:
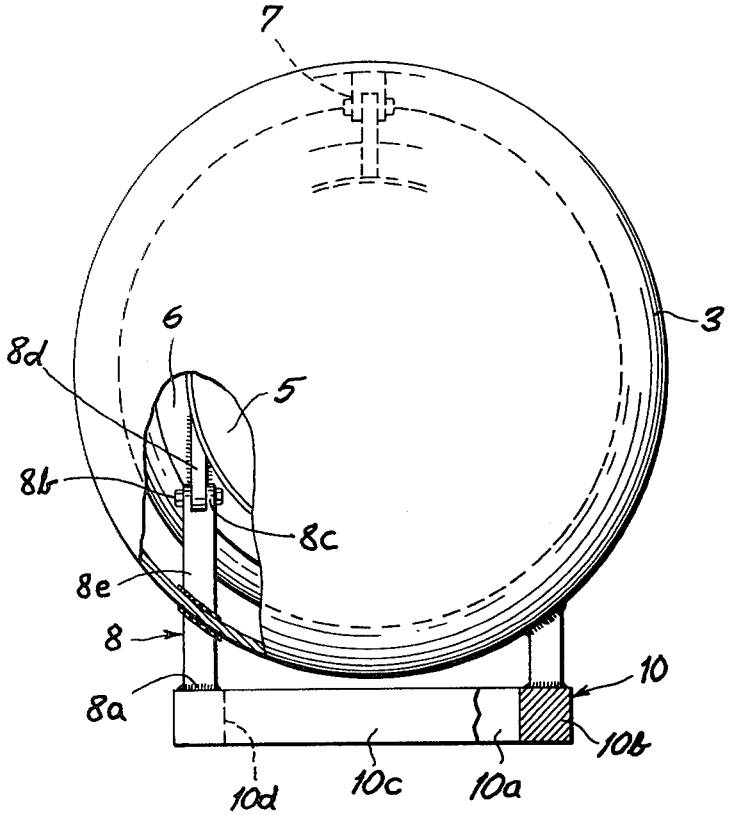
FIG. 7 is a view taken in the direction of arrow VII in FIG. 1.

The cylindrical intermediate part 4 can be, as can be seen from FIG. 7, of circular cross section although it may also be oval or even of polygonal cross section.

Stiffening bars 6 are welded to the cylinder bottoms 5 in the region of the rigid support elements 7. The stiffening bars can be of flat or other cross section.

The outer receptacle is here shown to be also general cylindrical and conmprises a cylindrical intermediate part 2 forming the cylindrical wall of this receptacle and two domed cylinder bottoms 3. The rigid support elements 7 support the outer receptacle upon the inner receptacle.

The entire vessel is carried by the frame 10 by mounts 8 and 9 reaching through the respective outer shell. At one end of the vessel, mounts 8, anchored at support elements between the inner and outer vessel, constitute fixed mounts and are not yieldable. They form pedestals rigidly connecting the cylinder bottom 5 with the frame 10 at one end of the liquefied-gas vessel. At the other end, the mounts 9 are yieldable permitting longitudinal movement (arrow A) but preventing vertical movement and movement perpendicular to the plane of the paper (transverse movement).

The corrugated cylinder wall 2 of the outer vessel has crests 2' and troughs 2'' which lie in planes perpendicular to the longitudinal axis of the vessel and hence this wall is elastically deformable in the direction of the longitudinal axis of the vessel. Circumferentially or peripherally, however, the wall 2 is so stiff that, upon the generation of a vacuum in the space between the inner and outer receptacles, no bulging of the outer receptacle occurs. The resulting vessel is especially stable against inwardly and outwardly acting pressures, reaction forces and thermal forces, in spite of the fact that the outer receptacle is not self-supporting but is carried and supported by the inner receptacle.

Figure 1:
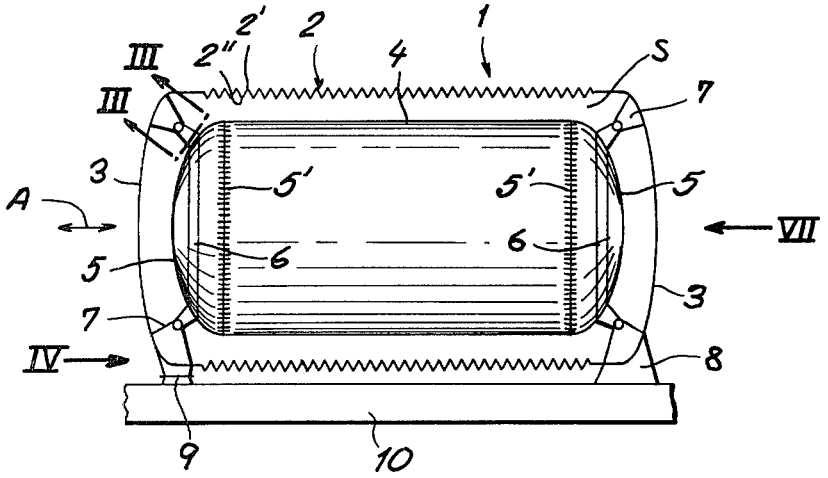
FIG. 1 is a diagrammatic longitudinal vertical section through the outer receptacle of a two-receptacle vessel for the storage and transportation of liquefied gases according to the invention.
Figure 2:
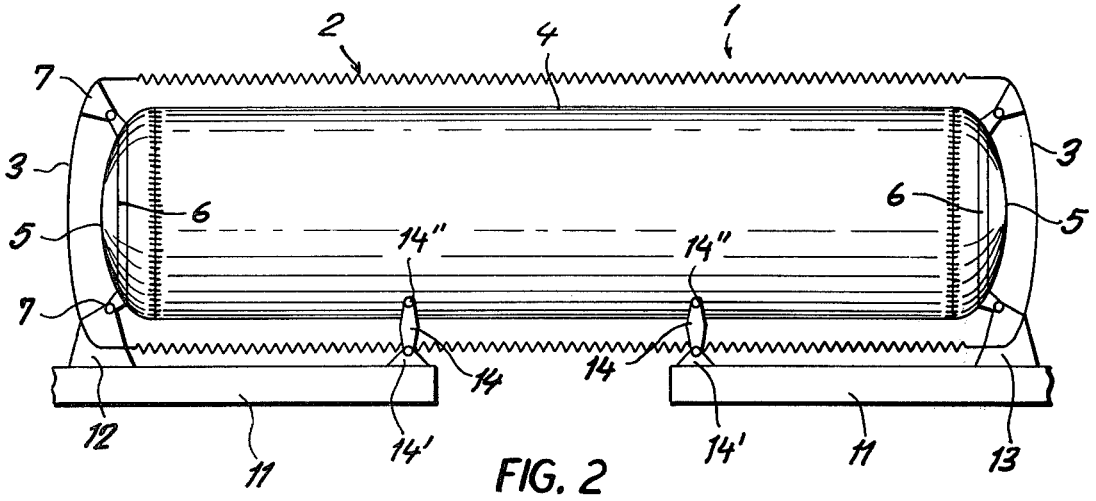
FIG. 2 is a view similar to FIG. 1 dealing with a longer vessel.

FIG. 2 shows a similar vessel 1 which, however, is mounted upon a divided frame 11. Here fixed mounts 12 and 13 support each end 5 of the inner receptacle and the corresponding shell 3 of the outer receptacle on a respective frame section. Between the shells 3, the cylinder walls 4 of the inner receptacle are carried upon links 14 pivotally connected to blocks 14' of the respective frame section and to the inner receptacle at 14''. The links 14 thus constitute yieldable mounts in the longitudinal direction but prevent vertical and transverse movement relative to the support frame.

Figure 3:
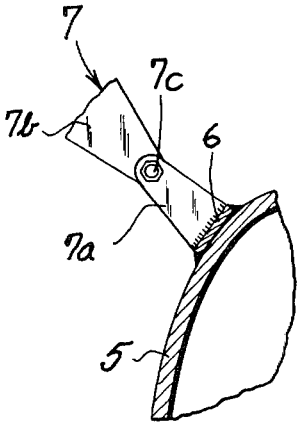
FIG. 3 is a cross-sectional view taken along the line III—III of FIG. 1.

As can be seen from FIG. 3, the rigid support connecting the outer to the inner receptacle can comprise a lug **7*a* welded to the reinforcing strap 6 and another lug 7*b* welded to the inner surface of one of the shells 3, the eyes of the lugs being interconnected by bolts or pins 7*c***.

Figure 4:
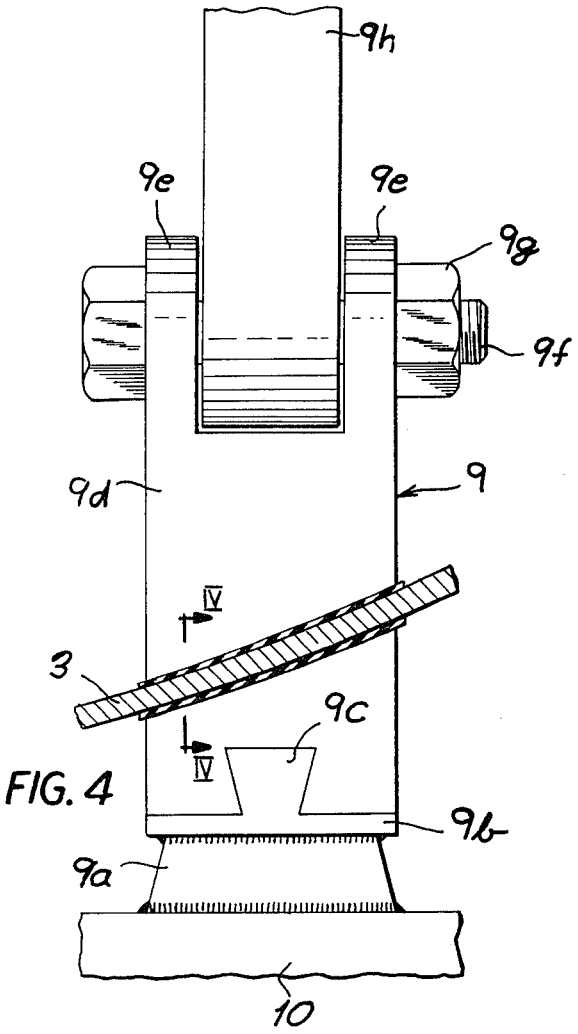
FIG. 4 is a detail view taken in the direction of arrow IV of FIG. 1.

The yieldable mounts 9 (FIG. 4) can comprise a lug **9*h*, similar to the lug 7*a* anchored to the reinforcing strap 6, whose eye is received between the eyes 9*e* of a bifurcated pedestal 9*d* having a dovetail recess guided along a dovetail key 9*c* of a pedestal plate 9*b* welded to a block 9*a* mounted upon the frame 10. A bolt 9*f* traverses the eye and is held in plate by a nut 9*g***.

Figure 4A:
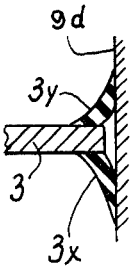
FIG. 4A is a section of the detail of FIG. 4 taken along line IVA—IVA thereof.

FIG. 4A shows a lip seal **3*x*, 3*y*** between the outer shell and the support pedestal which traverses the outer shell.

Figure 5:
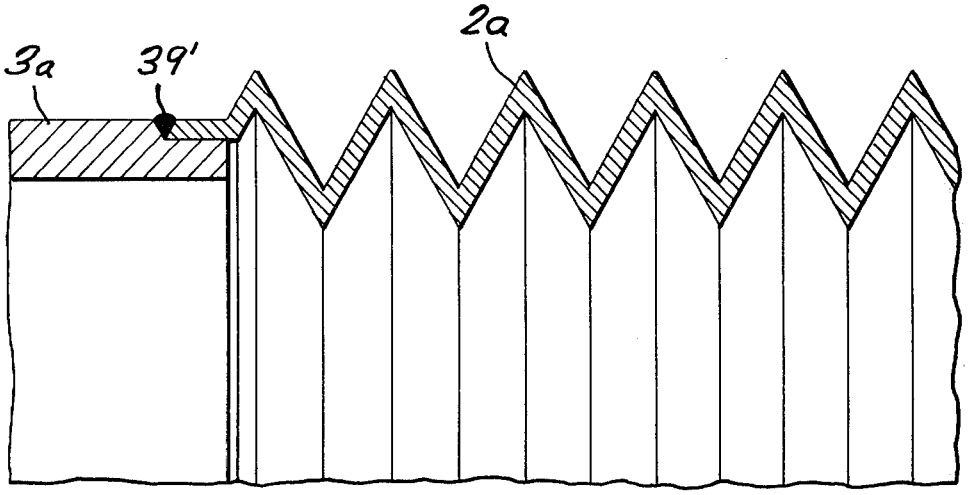
FIGS. 5 and 6 are detail cross-sectional views taken at the juncture of the corrugated parts of outer vessels with the domed cylinder bottoms of two embodiments of a vessel according to the invention.

FIG. 5 shows that the shell 3 can be a relatively thick wall member **3*a* which is welded to the corrugated wall section at 39', the corrugated wall section being here represented at 2*a*** and having angular corrugations.

Figure 6:
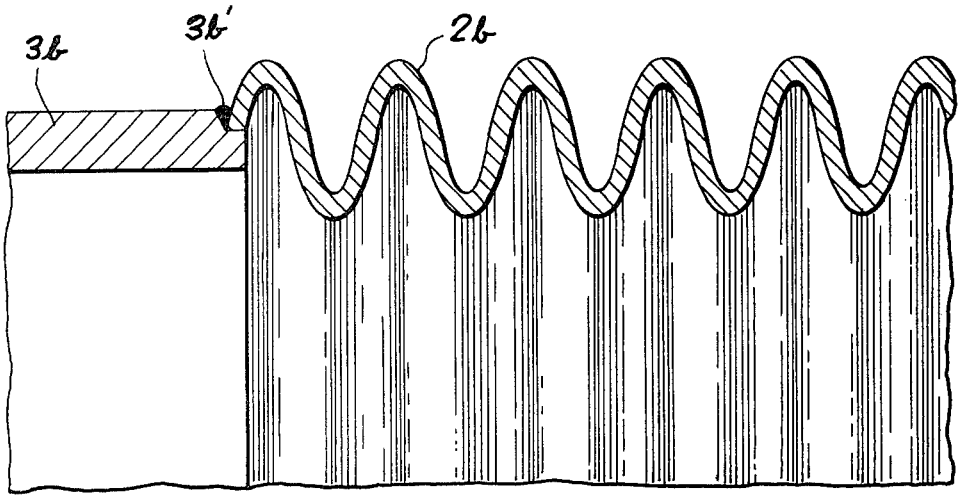

FIG. 6 illustrates an embodiment in which a weld **3*b'* is formed between the shell 3*b* and a corrugated wall 2*b*** whose corrugations are arcuate or curved in cross section.

FIG. 7 shows the frame 10 in somewhat more detail, the frame comprising a pair of longitudinal bars **10*b* and 10*d* interconnected by transverse bars 10*a* and 10*c*. The fixed mount 8 is shown to comprise a lug 8*d*, connected to the reinforcing strap 6 as described for the lug 7*a* receivable in a pedestal 8*e* which is bifurcated at 8*c*. The pedestal 8*e* is welded at 8*a* to the frame 10 and a bolt 8*b* connects the bifurcated pedestal with the lug 8*d*. Lip seals as shown in FIG. 4A can also be used between the pedestal 8*e*** and the outer shell. Thus only the inner shell is supported on the frame while the outer shell is fully suspended from the inner shell exclusively at locations offset from the axis of the shell.

I claim:

1. An insulated vessel for the storage or transport of liquefied gas comprising:

an inner axially elongated generally cylindrical receptacle receiving said liquefied gas;

an outer axially elongated generally cylindrical receptacle spacedly surrounding said inner receptacle and substantially coaxial therewith, said receptacles defining between them an empty evacuatable space, said outer receptacle comprising at its ends a pair of opposing shell members, said outer receptacle having an intermediate tubular member sealingly connected to said shell members and disposed between the shell members, said intermediate member being corrugated over its length with the corrugations formed by annular alternating troughs and crests, said troughs and crests each lying in a respective plane perpendicular to the longitudinal axis of said receptacles, said corrugations forming unitary stiffening formations of said intermediate member preventing radial expansion and contraction thereof but permitting elastic axial expansion and contraction of said intermediate member; and support elements rigidly connected to said inner receptacle engaging said shell members and supporting said outer receptacle on said inner receptacle.

2. The vessel defined in claim 1, further comprising a support frame disposed beneath said outer receptacle, and means traversing said outer receptacle for mounting said inner receptacle in load-transmitting relationship upon said frame.

3. The vessel defined in claim 2 wherein said means includes fixed mounts on said frame engaging one end of said inner receptacle and longitudinally yieldable mounts on the other end of said frame engaging the opposite end of said inner receptacle.

4. The vessel defined in claim 1, claim 2 or claim 3 wherein said support elements constitute the exclusive connections between said receptacles and are all offset from the axis of said inner receptacle, said receptacles each being formed with domed ends and said elements interconnecting corresponding domed ends of said inner and outer receptacles.

5. The vessel defined in claim 4 wherein the wall thickness of said inner receptacle being greater than that of the outer receptacle.

6. The vessel defined in claim 1, further comprising frame means having a pair of divided frame sections beneath said outer receptacle, fixed mounts on each of said frame sections each engaging a respective end of said inner receptacle, and longitudinally yieldable mounts between each frame section and portions of said inner recptacle intermediate said ends.

* * * * *